United States Patent [19]

Faulkner

[11] Patent Number: 4,577,702

[45] Date of Patent: Mar. 25, 1986

[54] METHOD OF PREVENTING DRILL STRING OVERFLOW

[75] Inventor: Ben V. Faulkner, Washington, Okla.

[73] Assignee: Faulkner Oil Field Services, Inc., Washington, Okla.

[21] Appl. No.: 717,497

[22] Filed: Mar. 28, 1985

[51] Int. Cl.[4] ..... E21B 7/00; E21B 17/00

[52] U.S. Cl. ..... 175/65; 166/317; 166/373

[58] Field of Search ..... 175/65, 66, 320, 324; 166/373, 317, 318

[56] References Cited

U.S. PATENT DOCUMENTS

| | | | |
|---|---|---|---|
| 2,178,845 | 11/1939 | Baker | 166/317 X |
| 2,903,074 | 9/1959 | Layton et al. | 166/317 |
| 2,922,479 | 1/1960 | Kinley | 166/317 |
| 2,947,363 | 8/1960 | Sackett et al. | 166/224 |
| 3,095,040 | 6/1963 | Bramlett | 166/317 |
| 3,527,297 | 9/1970 | Todd | 166/154 |
| 3,599,713 | 8/1971 | Jenkins | 166/224 |
| 3,907,046 | 9/1975 | Gaylord | 175/235 |
| 3,963,077 | 6/1976 | Faulkner | 166/315 |
| 4,031,957 | 6/1977 | Sanford | 166/264 |
| 4,176,717 | 12/1979 | Hix | 166/289 |
| 4,260,017 | 4/1981 | Nelson et al. | 166/154 |
| 4,300,636 | 11/1981 | Lawrence | 166/334 |
| 4,351,400 | 9/1982 | Faulkner | 175/69 |
| 4,394,880 | 7/1983 | Faulkner | 175/69 |
| 4,406,335 | 9/1983 | Koot | 175/317 |
| 4,427,070 | 1/1984 | O'Brien | 166/317 |
| 4,460,048 | 7/1984 | Smith et al. | 166/373 X |
| 4,478,244 | 10/1984 | Garrett | 137/515 |

*Primary Examiner*—Stephen J. Novosad
*Assistant Examiner*—David J. Bagnell
*Attorney, Agent, or Firm*—C. Clark Dougherty, Jr.

[57] ABSTRACT

A method of preventing drilling fluid overflow during the drilling of a well bore when the drill string suspended within the well bore is raised and drill pipe sections are removed therefrom such as when it is necessary to replace the drill bit. In accordance with the method, a tool joint is connected in the drill string near the bottom end thereof which includes at least one shear plug sealingly attached thereto which when sheared provides a drilling fluid flow passageway from the interior to the exterior of the tool joint. The shear plug in the tool joint is sheared whereby drilling fluid contained in the drill string is drained therethrough when the drill string is raised followed by the raising of the drill string and the removal of drill pipe sections therefrom.

12 Claims, 4 Drawing Figures

METHOD OF PREVENTING DRILL STRING OVERFLOW

BACKGROUND OF THE INVENTION

1. Field of the Invention

The present invention relates to a method of preventing drill string overflow, and more particularly, but not by way of limitation, to an improved method of lowering the level of drilling fluid in a drill string below the point at which drill pipe sections are removed therefrom.

2. Description of the Prior Art

In the rotary drilling of well bores penetrating subterranean formations utilizing drill strings suspended in the well bores, it is frequently necessary to withdraw the drill strings from the well bores to replace worn-out drill bits and/or to carry out other remedial or treating procedures.

During the drilling of a well bore, drilling fluid is circulated from the surface through the drill string, through ports or nozzles in the drill bit attached to the lower end of the drill string and back to the surface by way of the annulus between the drill string and the walls of the well bore. When drilling is stopped for the removal of the drill string from the well bore, because the drilling fluid in the annulus contains cuttings from the formation being drilled, it has a higher density than the drilling fluid contained within the drill string. This difference in drilling fluid density causes the level of the drilling fluid in the drill string to be higher than the level of drilling fluid in the annulus. Further, the ports or nozzles in the drill bit at the bottom of the drill string restrict the rate of drainage of drilling fluid from the drill string as it is raised whereby the level is not immediately appreciably lowered therein. The combination of the above factors results in the level of drilling fluid in the drill string usually always being above the rig floor which in turn causes drilling fluid to overflow at the point of drill string disconnection. Such overflow is undesirable for the reasons, among others, that the drilling fluid which overflows is lost, unsafe working conditions for personnel are created, and pollution of the environment results.

When a drill string is removed from a well bore for any reason, it is usually always necessary that the well bore and the portion of the drill string suspended therein remain full of drilling fluid in order to prevent formation fluid blowouts. That is, when the well bore penetrates formations containing formation fluids under pressure, the column of drilling fluid in the well bore extending from the formation to the surface prevents the formation fluids from blowing out. The drilling fluid is maintained at a predetermined density whereby a higher pressure is produced on the formation by the hydrostatic head of the drilling fluid than the pressure of the fluids in the formation. This pressure differential prevents the formation fluids from entering the well bore and blowing the drilling fluid out of the annulus, etc.

In order to prevent blowouts as a result of drilling fluid overflow and the resulting loss of hydrostatic pressure exerted within the well bore by the column of drilling fluid therein, various procedures have heretofore been followed. In one procedure, a quantity of very high density drilling fluid is prepared, e.g., 40 to 50 sacks of weighting material is added to 30 to 50 barrels of drilling fluid and the resulting high density fluid is pumped into the drill string to thereby create an imbalance in density between the inside and outside drilling fluid columns. The presence of the high density fluid within the drill string is intended to cause the level therein to be lower than the column of drilling fluid in the annulus and lower than the drilling rig floor whereby overflow is prevented or reduced. This procedure is less than satisfactory for the reason that it is expensive and time-consuming to carry out and can result in high hydrostatic pressures being exerted in the well bore which cause adverse results. For example, too high a hydrostatic pressure can cause one or more formations penetrated by the well bore to fracture which in turn can cause a sudden drilling fluid loss to the formations and a blowout to occur as a result thereof.

Another procedure which has been followed is to simply put up with drilling fluid overflow at the rig floor when the drill string is being removed and to continuously make up drilling fluid into the well bore to offset the loss of the overflowing drilling fluid and prevent a blowout.

Yet another commonly followed, but more dangerous procedure has been to contend with overflow when removing the drill string without adding additional drilling fluid to the well bore. The level of drilling fluid in the well bore is lowered by the overflow and the overflow subsequently stops whereby the portion of the drill string remaining in the well bore is removed without overflow. This procedure obviously risks a blowout in that the height of the column of drilling fluid remaining in the well bore when the overflow at the drilling rig floor is stopped is unknown.

Methods have heretofore been developed and used for expediting the draining and equalization of drilling fluid which involves the injection of pressurized air or other gas into the drill string to lower the level of drilling fluid therein. While a number of such methods have been effective, they have not received wide acceptance partially because of the large quantities of gas required for displacing the drilling fluid and/or the relatively long periods of time required to achieve such displacement.

By the present invention an improved method of preventing drilling fluid overflow when raising a drill string suspended within a well bore and removing drill pipe sections therefrom is provided which is simple and requires very little time to carry out.

SUMMARY OF THE INVENTION

A method of preventing drilling fluid overflow when raising the drill string suspended within a well bore and removing drill pipe sections therefrom comprising the steps of connecting a tool joint in the drill string near the bottom end thereof which includes at least one shear plug sealingly attached thereto for providing a drilling fluid flow passageway from the interior to the exterior of the tool joint when the plug is sheared, shearing the shear plug in the tool joint whereby drilling fluid contained in the drill string is readily drained therethrough when the drill string is raised and then raising the drill string and removing drill pipe sections therefrom.

It is, therefore, an object of the present invention to provide an improved method of preventing drill string overflow.

A further object of the present invention is the provision of a method of preventing drilling fluid overflow when removing the drill string from a well bore which is simply and easily carried.

Yet another object of the present invention is the provision of a method of preventing drill string overflow and thereby insuring the column of drilling fluid in the well bore is not lowered to the point where a blowout may occur which is efficient and requires very little time to carry out.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
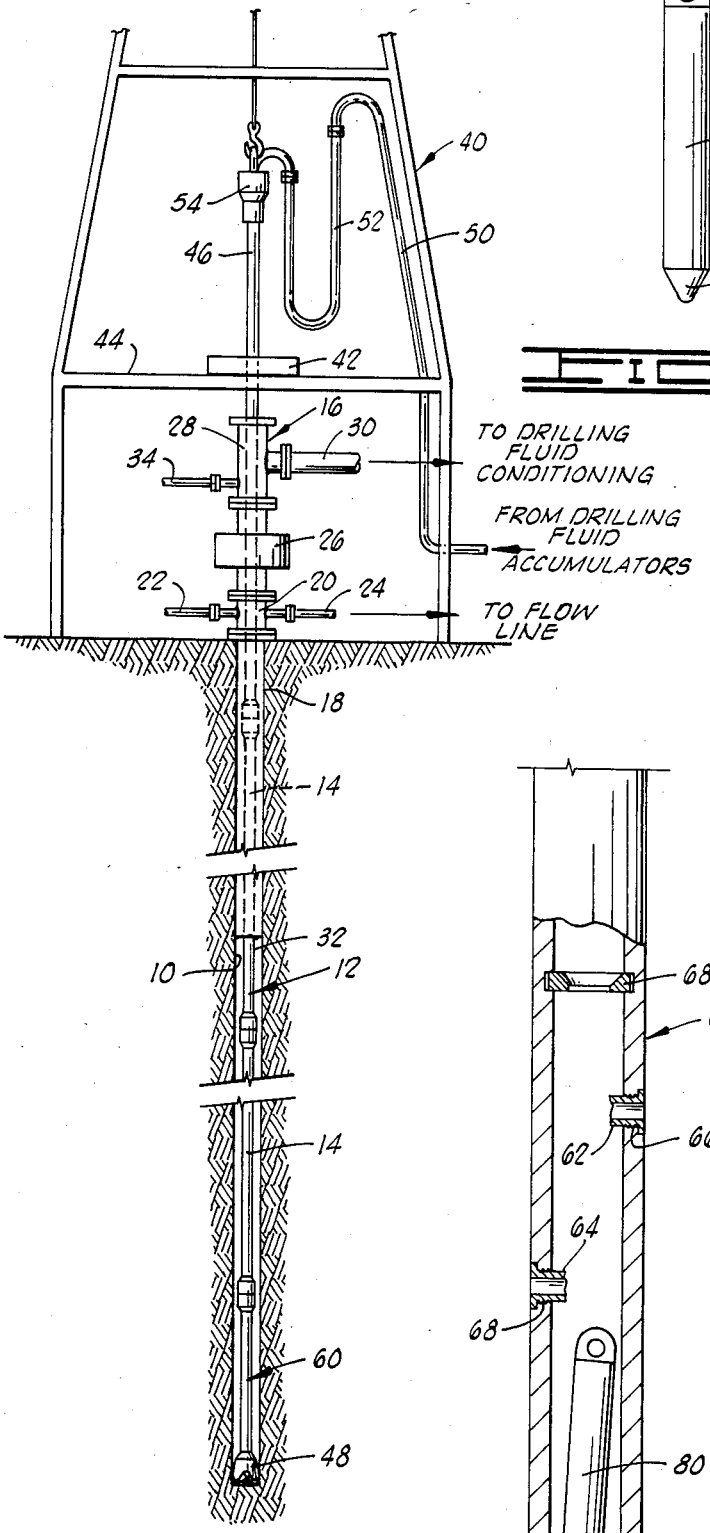
FIG. 1 is a diagrammatic illustration of a well bore having a rotary drilling rig positioned thereover and a drill string suspended therein.

Referring now to the drawings and particularly to FIG. 1, a well bore 10 is illustrated having a drill string 12 comprised of drill pipe sections 14 disposed therein. The well bore 10 is equipped with the usual arrangement of wellhead apparatus 16 including surface casing 18 disposed in the well bore 10 which is connected to a drilling spool 20 at the ground surface. A conduit 22 is connected to the drilling spool 20 which is utilized for adding weighted drilling fluid into the well bore 10 if a blowout occurs or is threatened and the annulus is closed by a blowout preventer. A second conduit 24 is connected to the spool 20 and to a flow line having a choke or other flow regulating valve disposed therein. The flow regulating valve is utilized to relieve formation fluid pressures from the well bore 10 in the event of a blowout or for other reason. Blowout preventer apparatus 26 is connected to the drilling spool 20 and a conventional bell nipple 28 is connected above the blowout preventer which completes the wellhead apparatus 16. A large diameter conduit 30 is connected to the nipple 28 for conducting circulated drilling fluid from the annulus 32 between the drill string 12 and the well bore 10 and between the drill string 12 and the surface casing 18 to drilling fluid pits or other drilling fluid accumulators (not shown). A second conduit 34 is connected to the bell nipple 28 for introducing drilling fluid into the annulus when refilling the annulus, etc.

A rotary drilling rig, generally designated by the numeral 40, is positioned above the well bore 10. The rig 40 includes a rotary table 42 on the rig floor 44 for engaging and rotating a kelly 46. The kelly 46 is in turn attached to the upper end of the drill string 12. A drill bit 48 is connected to the bottom end of the drill string 12, and as the drill string 12 is rotated, thereby rotating the drill bit against the bottom of the well bore 10, drilling fluid is circulated downwardly through the kelly 46 and the drill string 12, through nozzles in the drill bit 48, upwardly through the annulus 32 and through the wellhead apparatus 16 to drilling fluid conditioning facilities (not shown) by way of the conduit 30 connected to the wellhead apparatus 16. In the conditioning facilities, cuttings produced by the drill bit 48 are removed from the drilling fluid, the density of the drilling fluid is adjusted if necessary and other conditioning procedures are carried out in the drilling fluid. The resulting conditioned drilling fluid is pumped from drilling fluid accumulation pits or other form of accumulators into and through the usual stand pipe 50 and through a flexible hose 52. The flexible hose 52 is connected to a swivel 54 which is in turn connected to the top end of the kelly 46.

In accordance with the method of the present invention for preventing a drilling fluid overflow, a tool joint, generally designated by the numeral 60, is connected in the drill string 12 near the bottom end thereof. Preferably, as illustrated in FIGS. 1 and 2, the tool joint 60 is connected in the drill string at the bottom end thereof with the drill bit 48 connected to the lower end of the tool joint 60.

Figure 2:
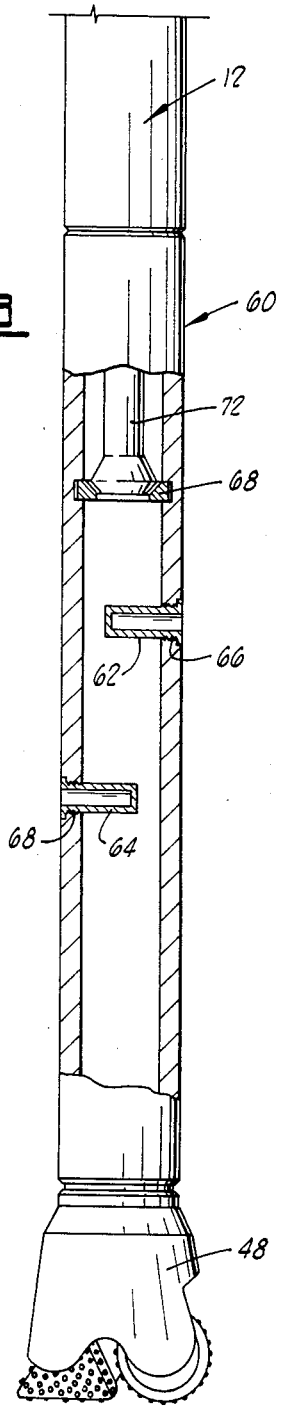
FIG. 2 is a side partly sectional view of a tool joint utilized in accordance with the method of the present invention attached at the bottom end of a drill string and having a drill bit attached thereto.

As best shown in FIG. 2, the tool joint 60 includes a pair of shear plugs 62 and 64 removably and sealingly connected through openings 66 and 68, respectively, positioned in the sides of the tool joint 60. The shear plugs 62 and 64 can take various forms, but preferably are cylindrical in shape, are threadedly connected in the openings 66 and 68 and extend transversely to the axis of the tool joint 60 at least partially across a portion of the interior thereof. The inner ends of the shear plugs 62 and 64 extending within the interior of the tool joint 60 are closed so that so long as the shear plugs 62 and 64 are intact, drilling fluid contained within the tool joint 60 is prevented from flowing to the exterior thereof through the plugs 62 and 64.

As will be understood by those skilled in the art, during the drilling of the well bore 10, the drilling fluid flowing downwardly through the drill string 12 passes through the tool joint 60 and exits the drill string by way of nozzles (not shown) in the drill bit 48. Also, during drilling, it is frequently necessary to run an instrument inside the drill string to survey the deviation from vertical, if any, of the well bore being drilled. Generally, the deviation survery instrument is run by lowering it on a wire line through the interior of the drill string to a point adjacent the top of the drill bit. In order to prevent the inadvertent shearing of the shear plugs 62 and 64 when the deviation survey instrument is run within the drill string 10, the tool joint 60 includes a deviation survey instrument stop ring 68 disposed therein. More specifically, the deviation survey instrument stop ring 68 is of a size such that the deviation survey instrument will not pass through the interior of the stop ring and will seat thereon. While the stop ring 68 can be attached within the tool joint 60 in various ways and can take various forms, a presently preferred technique is to form an internal groove 70 in the interior surface of the tool joint 60 which is perpendicular to the axis thereof. The stop ring 68 is made in the form of a snap ring and is expanded into the groove 70 after being positioned adjacent thereto. The exposed upwardly facing edge of the stop ring 68 is preferably beveled to facilitate the passage of an impact tool therethrough as will be described hereinbelow and to receive the leading end of a deviation survey instrument 72 when the instrument is landed thereon as shown in FIG. 2.

Figure 3:
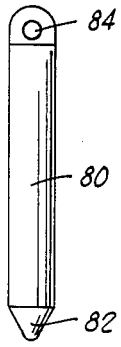
FIG. 3 is a side elevational view of an impact bar utilized in accordance with the present invention.
Figure 4:
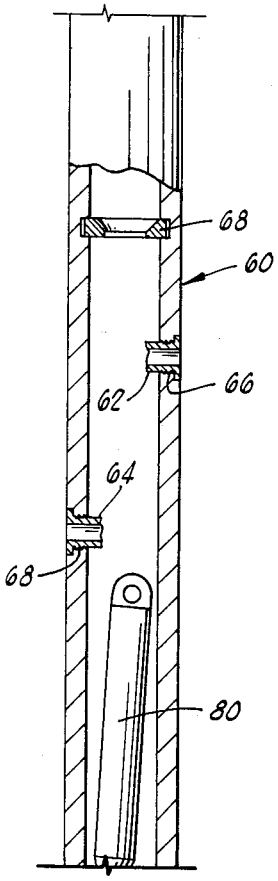
FIG. 4 is a side partly sectional view of a portion of the tool joint of FIG. 2 after the shear plugs thereof have been sheared by the impact bar of FIG. 3.

In carrying out the method of the present invention for preventing drilling fluid overflow when raising a drill string suspended within a well bore and removing drill pipe sections therefrom, such as when the drill 48 becomes ineffective due to wear and must be replaced with a new drill bit, an impact bar 80 (FIG. 3) is utilized in conjunction with the tool joint 60. More specifically, when the drill string 12 is to be removed from the well bore 10, the drilling process is stopped, i.e., the rotation of the drill string and pumping of drilling fluid therethrough is stopped. The drill string 12 is then raised by the drilling rig 40 in a conventional manner and the kelly 46 is removed therefrom. The impact bar 80 illustrated in FIG. 3 is next inserted into the interior of the drill string at the open top end thereof and dropped whereby it is propelled by gravity through the interior of the drill string and through the drilling fluid contained therein. When the impact bar 80 reaches the tool joint 60 it passes through the stop ring 68 and impacts and shears the inwardly extending portions of the shear plugs 62 and 64 as illustrated in FIG. 4 after impacting and shearing the plugs 62 and 64, the impact bar 80 comes to rest at the bottom of the tool joint 60 adjacent the drill bit 48.

The shearing or breaking of the shear plugs 62 and 64 causes drilling fluid flow passages through the shear plugs 62 and 64 to be opened. The shear plugs 62 and 64 are of sizes such that when the flow passages formed thereby are opened, drilling fluid readily flows therethrough. The drill string 12 is then raised whereby the top pipe section thereof can be removed therefrom. The raising of the drill string causes the drilling fluid within the drill string to drain therefrom by way of the openings in the plugs 62 and 64 as well as the nozzles in the drill bit 48 to the annular 32 and the columns of drilling fluid within and outside the drill string 12 to equalize. This, in turn, causes the level of the drilling fluid within the drill string 12 to remain below the point at which drill pipe sections are disconnected from the drill string, i.e., below the floor 44 of the drilling rig 40. As the drill string 12 is raised and additional drill pipe sections 14 successively removed therefrom, drilling fluid is continuously drained by way of the open shear plugs 62 and 64 in the tool joint 60 and the drill bit nozzles whereby the level of drilling fluid within the drill string stays below the point of disconnection of drill pipe sections therefrom and drilling fluid overflow is prevented.

As will be understood, the impact bar 80 can take various forms, but generally is of a size and weight whereby it freely passes through the interior of the drill string 12, resists being caught on the stop ring 68 and other protrusions within the drill string and impacts the shear plugs 62 and 64 with sufficient force to bring about the shearing thereof. Preferably, as illustrated in FIG. 3, the leading end portion 82 of the bar 80 is tapered whereby it resists becoming stuck or appreciably slowed down while passing through the drill string 12 and stop ring 68. For ease of handling, the rearward end of the impact bar 80 includes an eyelet 84 formed therein for receiving a hook or cable.

In order to facilitate a clear understanding of the method of the present invention, the following example is given.

EXAMPLE

A well bore is drilled utilizing a drill string consisting of standard relatively lightweight drill pipe segments forming the upper portion of the string and a heavier bottom portion formed of larger diameter drill pipe sections known in the art as drill collars. The purpose of using the drill collars at the bottom of the drill string is to supply a concentrated weight to the drill bit during drilling. The lighter weight and smaller diameter upper drill pipe sections serve to conduct drilling fluid to the drill bit and to rotate the drill collars and drill bit. The drill collars have an outside diameter of $6\frac{1}{4}$ inches and an inside diameter of 2 13/16 inches.

A tool joint 60 also having an outside diameter of $6\frac{1}{4}$ inches and an inside diameter of 2 13/16 inches is connected at the bottom end of the drill string and the drill bit is connected to the bottom of the tool joint. The stop ring 68 disposed within the tool joint 60 has an inside diameter of 1 15/16 inches and is installed 24 inches above the lower end of the tool joint. The shear plugs 62 and 64 are each formed of brass and have an outside diameter of $1\frac{1}{4}$ inches and an inside diameter of 1 inch. Each of the shear plugs 62 and 64 are threadedly connected in the threaded openings 66 and 68 in the sides of the tool joint 60 and protrude into the interior of the tool joint a distance of $1\frac{3}{4}$ inches. The shear plug 62 is positioned 4 inches below the stop ring 68 and the shear plug 64 is positioned on the opposite side of the tool joint 4 inches below the plug 62.

During drilling and during the life of the drill bit connected to the drill string, a deviation survey instrument measuring 8 feet in length and 1 5/16 inches in diameter equipped with a spear-shaped head at the bottom of $2\frac{3}{8}$ inches in diameter is run into the drill string on a wire line. The spear-shaped head of the instrument seats on the stop ring 68 but will not pass through the stop ring. Thus, the deviation surveys are made in close proximity to the bit at the bottom of the drill string without disturbing the impact plugs 62 and 64.

When it is necessary to replace the bit connected to the drill string, the impact bar 80 which has a $1\frac{1}{2}$-inch outside diameter and a 24-inch length is inserted into the drill string at the top end thereof and dropped through the drill string to the bottom of the tool joint 60. The impact bar 80 shears the shear plugs 62 and 64 as it passes through the tool joint 60 forming two 1-inch drilling fluid flow passageways in the tool joint 60 which cause the drill string to be rapidly drained when raised and prevent overflow when drill pipe sections are removed therefrom.

As will be understood, the particular sizes and numbers of the shear plugs utilized in the tool joint 60 can vary widely depending upon the size of the nozzles utilized in the drill bit and other factors. Generally, however, the cross-sectional area of the flow passageways formed by the shear plugs when sheared is in the range of from about 8 to 10 times the cross-sectional area of the drill bit nozzles which results in a drilling fluid drainage rate through the passageways and the drill bit sufficiently high to prevent drilling fluid overflow.

Thus, the present invention is well adapted to carry out the objects and attain the ends and advantages mentioned as well as those inherent therein. While presently preferred embodiments of the invention have been described for purposes of this disclosure, numerous changes in the method steps and the construction and arrangement of parts of apparatus for carrying out the method will suggest themselves to those skilled in the art, which changes are encompassed within the spirit of this invention as defined in the appended claims.

What is claimed is:

1. A method of preventing drilling fluid overflow when raising a drill string suspended within a well bore and removing drill pipe sections therefrom comprising the steps of:

connecting a tool joint in said drill string near the bottom end thereof, said tool joint including at least one shear plug sealingly attached thereto for providing a drilling fluid flow passageway from the interior to the exterior of said tool joint when sheared;

shearing said shear plug in said tool joint whereby drilling fluid contained in said drill string is drained therethrough when said drill string is raised; and then raising said drill string and removing drill pipe sections therefrom.

2. The method of claim 1 wherein said shear plug is removably connected through an opening in a side of said tool joint and extends transversely at least partially across a portion of the hollow interior thereof.

3. The method of claim 2 wherein said shear plug is sheared by impacting it with an impact bar inserted into the interior of and dropped from the top end of said drill string.

4. The method of claim 3 wherein said tool joint is further characterized to include a deviation survey instrument stop ring through which said impact bar will pass disposed within said tool joint above said shear plug.

5. The method of claim 4 wherein said tool joint includes two or more shear plugs removably connected through openings positioned one above the other in the side of said tool joint.

6. In a method of replacing the drill bit connected to the bottom end of a drill string suspended in a well bore wherein said drill string is raised and drill pipe sections are successively removed from the top end thereof, the improvement whereby during the raising of and the removal of drill pipe sections from said drill string, drilling fluid overflow from the top of said drill string is prevented comprising:

connecting a tool joint in said drill string near the bottom end thereof prior to suspending said drill string in said well bore, said tool joint including at least one shear plug sealingly attached thereto for providing a drilling fluid flow passageway from the interior to the exterior of said tool joint when sheared;

shearing said shear plug in said tool joint whereby drilling fluid contained in said drill string is drained therethrough when said drill string is raised; and then raising said drill string and removing drill pipe sections therefrom.

7. The method of claim 6 wherein said shear plug is removably connected through an opening in a side of said tool joint and extends transversely at least partially across the hollow interior thereof.

8. The method of claim 7 wherein said shear plug is sheared by impacting it with an impact bar inserted into the interior of and dropped from the top end of said drill string.

9. The method of claim 8 wherein said tool joint is further characterized to include a deviation survey instrument stop ring through which said impact bar will pass disposed within said tool joint above said shear plug.

10. The method of claim 9 wherein said tool joint includes two or more shear plugs removably connected through openings positioned one above the other in the sides of said tool joint.

11. The method of claim 10 wherein said tool joint is connected in said drill string at the bottom end thereof and said drill bit is removably connected to the bottom end of said tool joint.

12. The method of claim 11 wherein said impact bar includes a tapered bottom end for facilitating the passage of said bar through said drill string and through said deviation instrument stop ring of said tool joint.

* * * * *